US005709834A

United States Patent [19]

Lin

[11] Patent Number: 5,709,834

[45] Date of Patent: Jan. 20, 1998

[54] DEVICE FOR REMOVING GAS AND IMPURITIES FROM THE MOLTEN ALUMINUM

[76] Inventor: Yeun-Junn Lin, 5F, NO. 23, Lane 10, Tian Bao Street, Taichung, Taiwan

[21] Appl. No.: 712,466

[22] Filed: Sep. 11, 1996

[51] Int. Cl.[6] ..... C21C 7/00

[52] U.S. Cl. ..... 266/217; 266/235

[58] Field of Search ..... 266/235, 200, 266/225, 217

[56] References Cited

U.S. PATENT DOCUMENTS

| | | | |
|---|---|---|---|
| 3,227,547 | 1/1966 | Szekely | 266/235 |
| 3,982,913 | 9/1976 | Feichtinger | 266/235 |
| 4,802,656 | 2/1989 | Hudault et al. | 266/235 |
| 5,364,078 | 11/1994 | Pelton | 266/235 |

*Primary Examiner*—Scott Kastler
*Attorney, Agent, or Firm*—Browdy and Neimark

[57] ABSTRACT

A device for removing gas and impurities from the molten aluminium is composed of a driving portion, a transmission portion, and an agitating portion. The driving portion has an output shaft while the transmission portion has a transmission shaft such that the axis of the transmission shaft is parallel to the axis of the output shaft, and that the transmission shaft is driven by the output shaft. The agitating portion comprises a plurality of blades, which are driven by the transmission shaft. Each blade has an upper end surface and a lower end surface, which form respectively a predetermined angle with the axis of the transmission shaft. The transmission shaft is provided with an axial hole of a predetermined length. Each blade is provided therein with a channel for expelling the gas contained in the molten aluminium.

3 Claims, 2 Drawing Sheets

DEVICE FOR REMOVING GAS AND IMPURITIES FROM THE MOLTEN ALUMINUM

FIELD OF THE INVENTION

The present invention relates generally to a device for casting an aluminum product, and more particularly to a device for removing gas and impurities from the molten aluminum.

BACKGROUND OF THE INVENTION

In the process of making an aluminum alloy product by die casting or pouring, the aluminum ingot is melted and is then injected into the molding tool. The molten aluminum is susceptible to a chemical reaction in which the aluminum reacts with the atmospheric water vapor to produce hydrogen and aluminum oxide, as illustrated by the chemical equation of $3H_2O+2Al \rightarrow 3H_2+Al_2O_3$. As a result, the molten aluminium is injected into the molding tool along with hydrogen and aluminium oxide, which cause the aluminum product to have uneven structural strength and uneven surfaces.

The conventional way to deprive the molten aluminium of hydrogen and aluminum oxide is to make use of a quartz pipe, which is installed at the bottom of a vessel containing the molten aluminum for injecting chlorine or nitrogen into the molten aluminium. In the meantime, the molten aluminum is agitated manually with an iron rod or a carbon rod to promote the chemical reaction between hydrogen and chlorine or nitrogen, thereby resulting in the floating of the aluminium oxide mass on the surface of the molten aluminium. The gas formed by the combination of hydrogen and chlorine or nitrogen is allowed to escape into the atmosphere while the aluminum oxide mass is removed to purify the molten aluminium.

Such a conventional way of depriving the molten aluminium of gas and impurities as described above is defective in design in that it is hazardous to an operator's safety, the manual agitation of the molten aluminum is inefficient at best, the agitating iron rod is vulnerable to corrosion, and the agitating carbon rod is rather expensive.

SUMMARY OF THE INVENTION

It is therefore the primary objective of the present invention to provide a highly automated device for removing gas and impurities from the molten aluminum.

It is another objective of the present invention to provide a device capable of agitating the molten aluminium effectively and thoroughly.

It is still another objective of the present invention to provide a device capable of injecting the gas into the molten aluminum such that the gas is diffused throughout the molten aluminum to remove the hydrogen gas present in the molten aluminum.

The device of the present invention is composed of a driving portion, a transmission portion, and an agitating portion. The driving portion has an output shaft while the transmission portion has a transmission shaft such that the axis of the transmission shaft is parallel to the axis of the output shaft, and that the transmission shaft is driven by the output shaft. The agitating portion comprises a plurality of blades, which are driven by the transmission shaft. Each of the blades has an upper end surface and a lower end surface, which form respectively a predetermined angle with the axis of the transmission shaft. The transmission shaft is provided with an axial hole of a predetermined length. Each of the blades is provided therein with a channel for expelling the gas contained in the molten aluminium.

The features, functions and advantages of the device of the present invention will be more readily understood upon a thoughtful deliberation of the following detailed description of a preferred embodiment of the present invention in conjunction with the accompanying drawings.

DETAILED DESCRIPTION OF THE INVENTION

Figure 1:
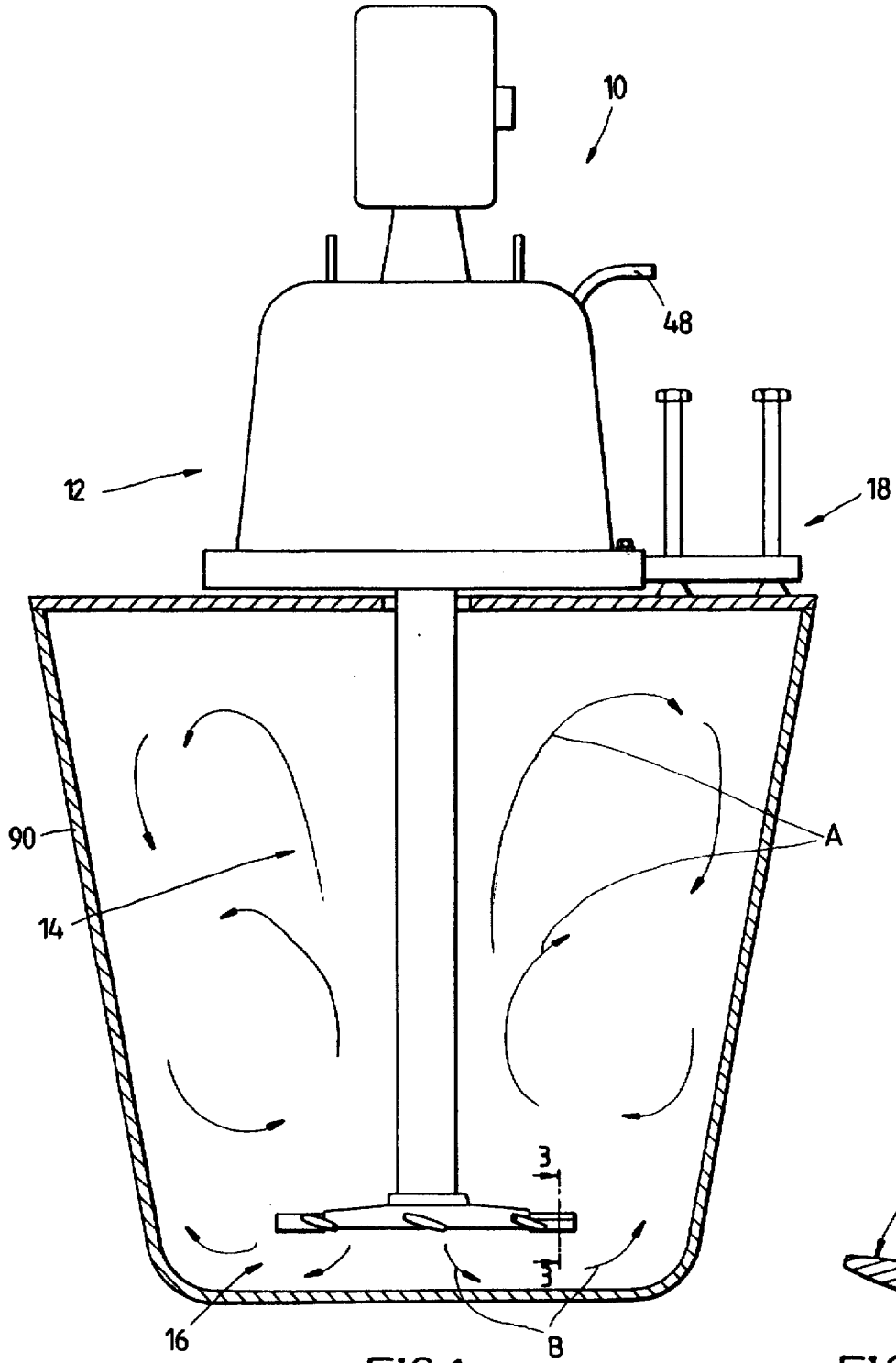
FIG. 1 shows a front view of the preferred embodiment of the present invention mounted on a crucible in which the aluminum ingots are melted.
Figure 3:
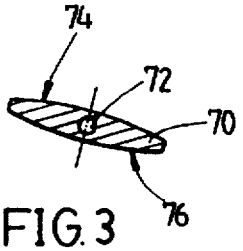
FIG. 3 shows a sectional view taken along the direction indicated by a line 3—3 shown in FIG. 1.
Figure 2:
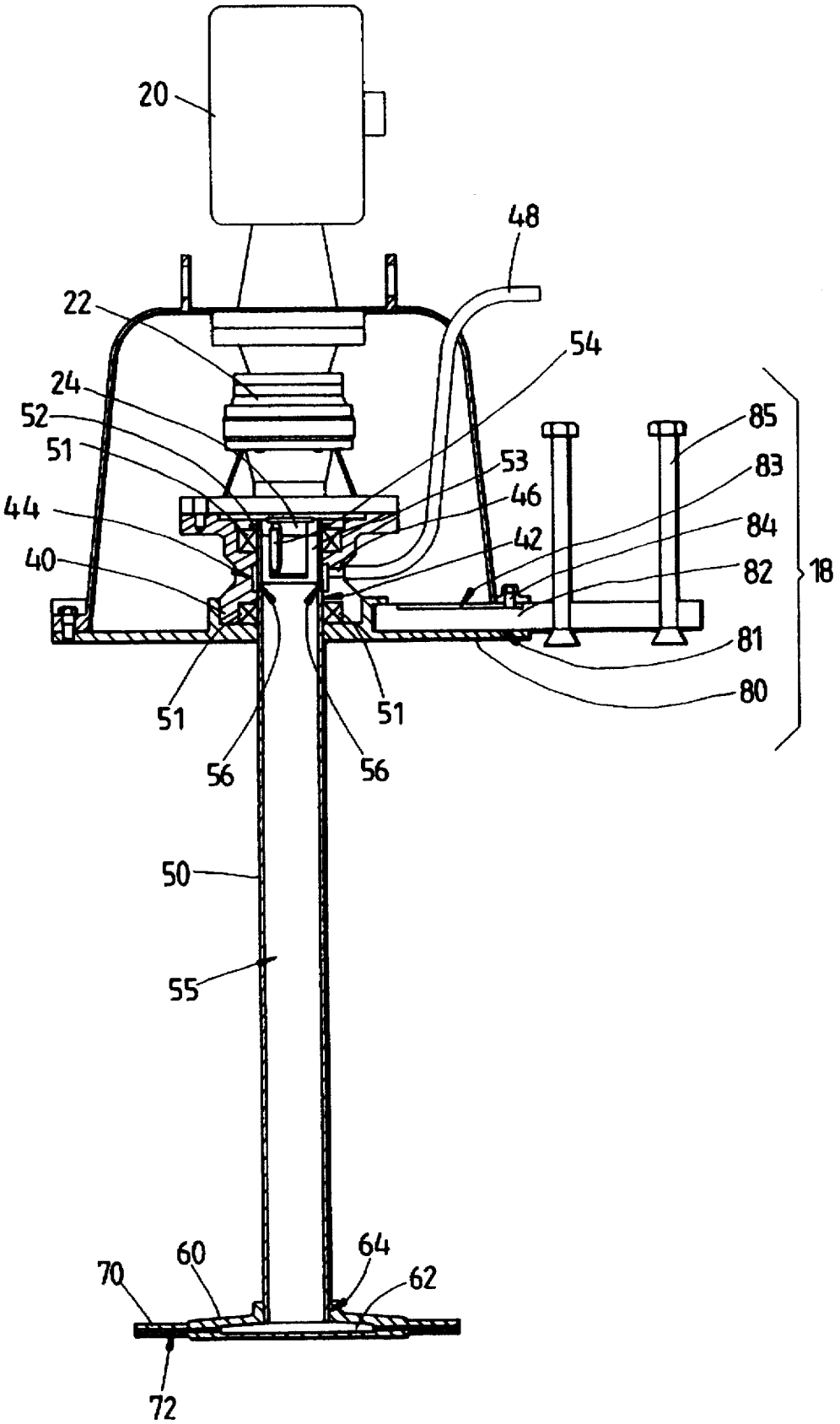
FIG. 2 shows a sectional view of the preferred embodiment of the present invention.

As shown in FIGS. 1–3, a device 10 of the present invention for removing gas and impurities in the molten aluminium is composed of a driving portion 12, a transmission portion 14 connected with the driving portion 12, and an agitating portion 16.

The driving portion 12 comprises a motor 20 and a deceleration device 22 connected with the motor 20 and provided with an output shaft 24 extending downwards and having an appropriate length.

The transmission portion 14 comprises a connection seat 40 and a transmission shaft 50. The connection seat 40 is located securely under the driving portion 12 and is provided with an axial hole 42 extending through the upper end and the lower end of the connection seat 40. The axial hole 42 is provided in the inner wall thereof with a ring slot 44. Located between the inner wall of the axial hole 42 and the outer wall of the connection seat 40 is a gas duct 46. The transmission shaft 50 is fastened pivotally at one end thereof with the axial hole 42 in conjunction with two bearings 51 and is provided with a C-shaped retaining ring 52 corresponding in location to the bearings 51. The transmission shaft 50 is further provided therein with a connection block 53 welded thereto for mounting the output shaft 24 of the deceleration device 22. The transmission shaft 50 is still further provided with a plurality of gas guiding holes 56 corresponding in location to the ring slot 44 so as to permit the axial hole 55 to be in communication with the gas duct 46 via the ring slot 44 at such time when the transmission shaft 50 is in motion.

The agitating portion 16 comprises a main body 60 and eight blades 70 fastened with the periphery of the main body 60 of a disklike construction. The main body 60 is provided in the interior thereof with a receiving cell 62 which has an opening 64 in communication with the upper side of the main body 60. The transmission shaft 50 is secured to the receiving cell 62 by welding such that the axial hole 55 of the transmission shaft 50 is in communication with the receiving cell 62. The blades 70 are provided respectively with a channel 72, an upper end surface 74, and a lower end surface 76. The upper end surface 74 and the lower end surface 76 are viewed from the longitudinal section of the blade 70. The normal line of the upper end surface 74 forms an angle with the axis of the transmission shaft 50.

In operation, the transmission portion 14 is driven by the driving portion 12 such that the blades 70 are actuated to rotate in the positive direction in the molten aluminium contained in a crucible 90, as shown in FIG. 1. The molten aluminium is thus stirred up in the directions indicated by arrows A in FIG. 1, thereby resulting in the upward circulation of aluminium oxide contained in the molten aluminium. As shown in FIG. 3, each blade 70 is slanted such that the molten aluminium is forced to move towards the bottom of the crucible 90, as indicated by arrows B in FIG. 1, when the transmission shaft 50 is driven by the driving portion 12 to rotate in a counterclockwise direction. In addition, when the blades 70 are at work to bring about agitation, nitrogen gas may be introduced into the ring slot 44 via a hose 48 in communication with the gas duct 46. The injected nitrogen gas is then transported from the ring slot 44 through the gas guide holes 56, the axial hole 55, the receiving cell 62 and the channels 72 to be mixed with the molten aluminium being agitated. The hydrogen gas present in the molten aluminium is thus combined with the injected nitrogen gas. In the meantime, aluminium oxide mass is forced to move towards the surface of the molten aluminum.

The device 10 of the present invention is composed of a base 18 to facilitate the mounting of the device 10 on the crucible 90. The base 18 comprises a seat body 80 having three slots 81 which are located in the periphery of the seat body 80 in a radiate manner that they form therebetween an angle of 120 degrees. Each of three slots 81 is provided therein with an extension rod 82 capable of sliding along the direction of the axis of the slot 81. The extension rods 82 are provided respectively with a groove 83 parallel to the axis of the extension rod 82. The seat body 80 is provided with three tightening screws 84 fastened therewith such that one end of each screw 84 is received in the groove 83 for locating the extension rod 82, which is therefore prevented from moving out of the slot 81. Each extension rod 82 has one end, which is located outside the slot 81 and is provided with a leg 85 fastened therewith. The extension rods 82 can be adjusted freely by an operator so as to enable the device 10 of the present invention to be mounted on the crucibles of various sizes.

What is claimed is:

1. A device for removing gas and impurities from the molten aluminum, said device comprising:

a driving portion having an output shaft;

a transmission portion having a transmission shaft which is driven by said output shaft and is provided with an axial hole;

an agitating portion having a plurality of blades fastened with said transmission shaft such that said blades extend outwards from an axis of said transmission shaft, an upper end surface and a lower end surface of said blades forming respectively with said axis of said transmission shaft an angle, said blades provided respectively with at least one channel in communication with said axial hole of said transmission shaft;

a connection seat having a through hole and a gas duct, said through hole of said connection seat being engaged pivotally with one end of said transmission shaft such that said gas duct of said connection seat is in communication with said axial hole of said transmission shaft;

said connection seat being fastened securely under said driving portion and having a ring slot in an inner wall of said through hole thereof; wherein said gas duct communicates between said ring slot and an outer side of said connection seat; wherein said transmission shaft is provided with at least one gas guiding hole in communication with said ring slot; and wherein said transmission shaft is provided with a main body fastened securely therewith, said main body provided therein with a receiving cell in communication with said axial hole of said transmission shaft and with said channels of said blades.

2. A device for removing gas and impurities from the molten aluminum, said device comprising:

a driving portion having an output shaft;

a transmission portion having a transmission shaft which is driven by said output shaft and is provided with an axial hole;

an agitating portion having a plurality of blades fastened with said transmission shaft such that said blades extend outwards from an axis of said transmission shaft, an upper end surface and a lower end surface of said blades forming respectively with said axis of said transmission shaft an angle, said blades provided respectively with at least one channel in communication with said axial hole of said transmission shaft;

a connection seat having a through hole and a gas duct, said through hole of said connection seat being engaged pivotally with one end of said transmission shaft such that said gas duct of said connection seat is in communication with said axial hole of said transmission shaft;

said connection seat being fastened securely under said driving portion and having a ring slot in an inner wall of said through hole thereof; wherein said gas duct communicates between said ring slot and an outer side of said connection seat; wherein said transmission shaft is provided with at least one gas guiding hole in communication with said ring slot;

wherein said transmission shaft is provided with a main body fastened securely therewith, said main body provided therein with a receiving cell in communication with said axial hole of said transmission shaft and with said channels of said blades; and a base having a seat body for mounting thereon said driving portion and three extension rods which are separated at an appropriate angle and have a predetermined length such that said extension rods can be moved back and forth on said seat body.

3. The device as defined in claim 2, wherein said seat body is provided with a plurality of tightening screws fastened therewith such that said extension rods are urged by said tightening screws; and wherein said extension rods are provided respectively with a movable leg.

* * * * *